US006315845B1

(12) United States Patent
Hartung et al.

(10) Patent No.: US 6,315,845 B1
(45) Date of Patent: Nov. 13, 2001

(54) METHOD OF STRAIGHTENING SECTIONAL STEEL WHILE SIMULTANEOUSLY MINIMIZING THE INTERNAL STRESSES THEREOF

(75) Inventors: Georg Hartung, Pulheim; Lutz Kümmel, Jüchen-Gierath; Bruno Böhmer, Erkrath; Wolfgang Roloff, Mönchengladbach, all of (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/339,547

(22) Filed: Jun. 24, 1999

(30) Foreign Application Priority Data

Jun. 27, 1998 (DE) ..... 198 28 784

(51) Int. Cl.[7] ..... C21D 8/00; B21D 3/00; B21D 25/04

(52) U.S. Cl. ..... 148/645

(58) Field of Search ..... 148/645

(56) References Cited

FOREIGN PATENT DOCUMENTS

62235423 * 10/1987 (JP) .
62235424 * 10/1987 (JP) .
1057561 * 11/1983 (SU) .

* cited by examiner

*Primary Examiner*—Sikyin Ip
(74) *Attorney, Agent, or Firm*—Friedrich Kueffner

(57) ABSTRACT

A method of straightening rolled sectional steel includes clamping and subsequently cooling at least a sectional steel whose maximum local cross-sectional temperature is below $A_{r1}$ and whose minimum local cross-sectional temperature is above a lower limit temperature, wherein already the lower limit temperature produces as a result of clamping a thermal elongation in all fibers of the sectional steel which is greater than the elongation which would be required for a plastification of the fibers which would be subjected to the greatest internal compressive stresses if the sectional steel were exclusively air cooled without clamping.

8 Claims, 5 Drawing Sheets

METHOD OF STRAIGHTENING SECTIONAL STEEL WHILE SIMULTANEOUSLY MINIMIZING THE INTERNAL STRESSES THEREOF

BACKGROUND OF THE INVENTION

1. Field of the Invention

The present invention relates to a method of straightening rolled sectional steel.

2. Description of the Related Art

Cooling of rolled sectional steel, for example, I-sections and U-sections or angles, usually takes place on a cooling bed. Because of non-uniform cooling, the sections become distorted. This distortion has a negative effect on the straightness and internal stress state of the sections. Taken together, these two quality criteria can be compared to the quality criterion flatness in strip rolling. A reduced straightness (section curvature, twist and bending curvature) frequently occurs when high internal stresses occur. Curved sections must be further processed. Internal stresses reduce the load bearing capacity of the sections.

In accordance with the prior art, when curvatures occur they are returned at low section temperatures by means of one or more straightening processes to a tolerable extent. Used for this purpose are roller straightening machines and straightening presses.

Roller straightening machines which continuously straighten the sections, initially produce another curvature of the section to a defined dimension. As this occurs, the existing internal stresses are eliminated by new defined internal stresses. However, this is inherently not possible over the entire cross-section of the section. In the area of the neutral fiber, a material area remains which is not influenced over the entire straightening process. After the first bending process has occurred, the product is subjected to a defined alternating bending with several changes of the curvature. This changes the internal stresses in such a way that the section is straight after the straightening process. Inherently, residual internal stresses remain. The internal stresses remaining in the sectional steel are a disadvantage because of the already mentioned problems with respect to the load bearing capacity of the sections. Sections with substantial curvatures additionally pose problems during the straightening process, for example, the threading-in into the machine.

In the discontinuously operating straightening press, individual portions of the sectional steel which are impermissibly strongly curved are one after the other compensated by a bending process which is as much as possible the opposite of the curvature. When using the straightening press, it is not possible to influence the internal stress state. The discontinuous and unknown internal stress state after the straightening process has a disadvantageous effect on the load bearing capacity of the section. This process harmfully influences the material flux during the manufacture of sectional steel and requires a lot of time.

SUMMARY OF THE INVENTION

Therefore, starting from the prior art discussed above, it is the primary object of the present invention to provide a method of straightening rolled sectional steel which does not require the complicated apparatus of the straightening devices described above and produces a sectional steel which is of high quality and is low in internal stress.

The straightening effect of the method according to the present invention is based on the known effect of straightening by stretching, as used, for example, in stretching devices in which the product is actively pulled or drawn until a plastic deformation occurs in the stretching direction over the cross-section of the product. However, in the method according to the present invention, and contrary to known methods and devices, the straightening effect is not achieved actively through tools which carry out a pulling and/or possible bending operation, but by transforming a thermal elongation into a plastic elongation of the sectional steel.

Specifically, in a method of the above-described type, this is achieved by clamping and subsequently cooling at least a sectional steel whose maximum local cross-sectional temperature is below $A_{r1}$ and whose minimum local cross-sectional temperature is above a lower limit temperature $\upsilon_u$ wherein already the lower limit temperature $\upsilon_u$ produces as a result of clamping a thermal elongation in all fibers of the sectional steel which is greater than the elongation which would be required for a plastification of the fibers which would be subjected to the greatest internal compressive stresses if the sectional steel were exclusively air cooled without clamping.

A prerequisite for carrying out the method according to the present invention is that the sectional steel is only clamped after it has been completely transformed. Due to cooling, the sectional steel held in stationary clamping means is elongated as a result of the temperature decrease (thermal elongation). This thermal elongation is transformed into a combined elastic/plastic elongation of the sectional steel. In spite of different plastic elongations over the cross-section of the sectional steel, the elastic elongation component is uniform, so that no curvature of the sectional steel has to be expected even after untensioning of the sectional steel. The reason for this is to be seen in the fact that, due to the generally low elongation difference over the cross-section of the sectional steel, no significant yield stress differences due to solidification have to be expected.

When the sectional steel is being clamped, the temperature of the sectional steel may not exceed $A_{r1}$ at any location of the sectional steel and may not drop below a lower limit temperature $\upsilon_u$ at any location. This is because if the temperature drops below the lower limit temperature $\upsilon_u$, the elongation in the clamped sectional steel resulting at this temperature is not sufficient for plasticizing those fibers which are subjected to the greatest internal compressive stress $E_{oD}$, max which occurs at normal air cooling of the sectional steel without clamping of the sectional steel.

The lower limit temperature $\upsilon_o$, at which the straightening method according to the present invention can still be carried out, can be obtained by computation using the following formula:

$$\vartheta_u = \vartheta_{\text{end of clamping}} + \frac{k_f + E_{\vartheta Di\,max}}{\alpha \cdot E}, \text{ wherein}$$

| | |
|---|---|
| $\upsilon_u$: | lower limit temperature |
| $\upsilon_{\text{end of clamping}}$: | temperature toward the end of clamping of the sectional steel, |
| $k_f$: | cold yield point of the sectional steel, |
| E: | modulus of elasticity E of the sectional steel at RT, |
| $\alpha$: | linear coefficient of thermal expansion of the sectional steel, |
| $E_{\sigma D}$, max: | maximum value of the internal compressive stress of the sectional steel when cooling the sectional steel in air without clamping. |

$\upsilon_{\text{end of clamping}} = 80°$ C. and $k_f = 380$ N/mm$^2$ results for steel in a lower limit temperature of about $\upsilon_u = 330°$ C.

In order to prevent damage at the usable portions of the sectional steel, the steel is clamped during cooling at its ends which are cut off after cooling.

When different rolled lengths of the sectional steel are produced, at least one of the means for clamping the sectional steel which are stationary during cooling must be moveable.

For reducing the internal stresses remaining in the section, it has been found advantageous to cool the clamped sectional steel to a temperature of below 100° C., particularly in the range of about 80° C., which is the temperature at which the sectional steel is usually transferred to a cooling bed. Since, in the method according to the present invention, the internal stresses remaining in the sectional steel depend primarily on the temperature level toward the end of the cooling process with the sectional steel being clamped, no significant thermal inhomogeneities and, thus, internal stresses have to be expected at these temperatures after further cooling to ambient temperature.

When the sectional steel is cooled in an accelerated manner, the time during which the clamping means and cooling devices are required for carrying out the method is shortened. This makes it possible to reduce the number of clamping means and cooling devices which are required for the throughput of the plant. In addition, the size of the cooling bed can be reduced because the total cooling time is significantly shorter.

In accordance with an advantageous feature, spray nozzles which are known in the art are used for the accelerated cooling of the sectional steel.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
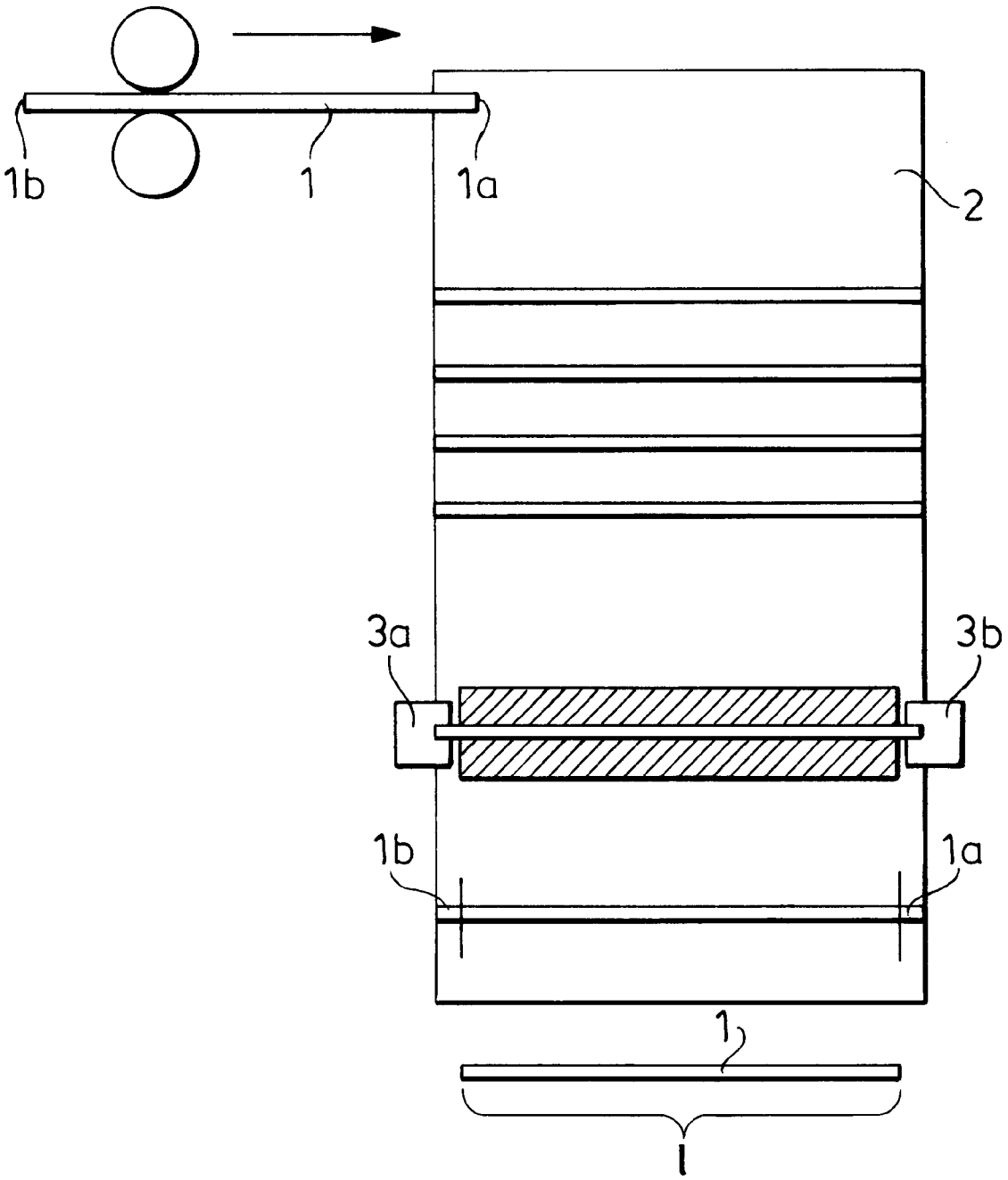
FIG. 1 is a schematic illustration of the sequence of steps carried out in accordance with the method of the present invention.

In the following, the method carried out in accordance with the present invention is explained with the aid of FIG. 1.

The rolled sectional steel 1 is transferred in the conventional manner to a cooling bed 2 and is conveyed transversely of the rolling direction to clamping means 3*a* , 3*b*, wherein the sectional steel is clamped by the clamping means 3*a*, 3*b* in the area of the ends 1*a*, 1*b* of the section. While the sectional steel is being clamped, the maximum local cross-sectional temperature of the steel is below $\upsilon_{r1}$ and its minimum local cross-sectional temperature is above a lower limit temperature $\upsilon_u$. As a result of further cooling of the sectional steel 1 after it has been clamped, the sectional steel is elongated (thermal elongation). This thermal elongation is converted into a combined elastic/plastic elongation of the sectional steel.

Once the sectional steel 1 is cooled to a temperature of about 80° C., the clamping means are removed and the sectional steel is then cut.

The useful length 1 of the sectional steel then cools to ambient temperature free of any significant thermal inhomogeneities and internal stresses. For cooling a sectional steel of the type HEB 140 having a length of 100 m to a final temperature of 80° C., the cooling time is 64 mins in the case of exclusive air cooling, the cooling time is 42 mins in the case of a forced air cooling with a row of fans, and the cooling time is only 10 mins in the case of water cooling for 10 seconds with a uniformly applied water quantity of 28 m$^3$ and a pressure of about 10 bars.

Figure 2:
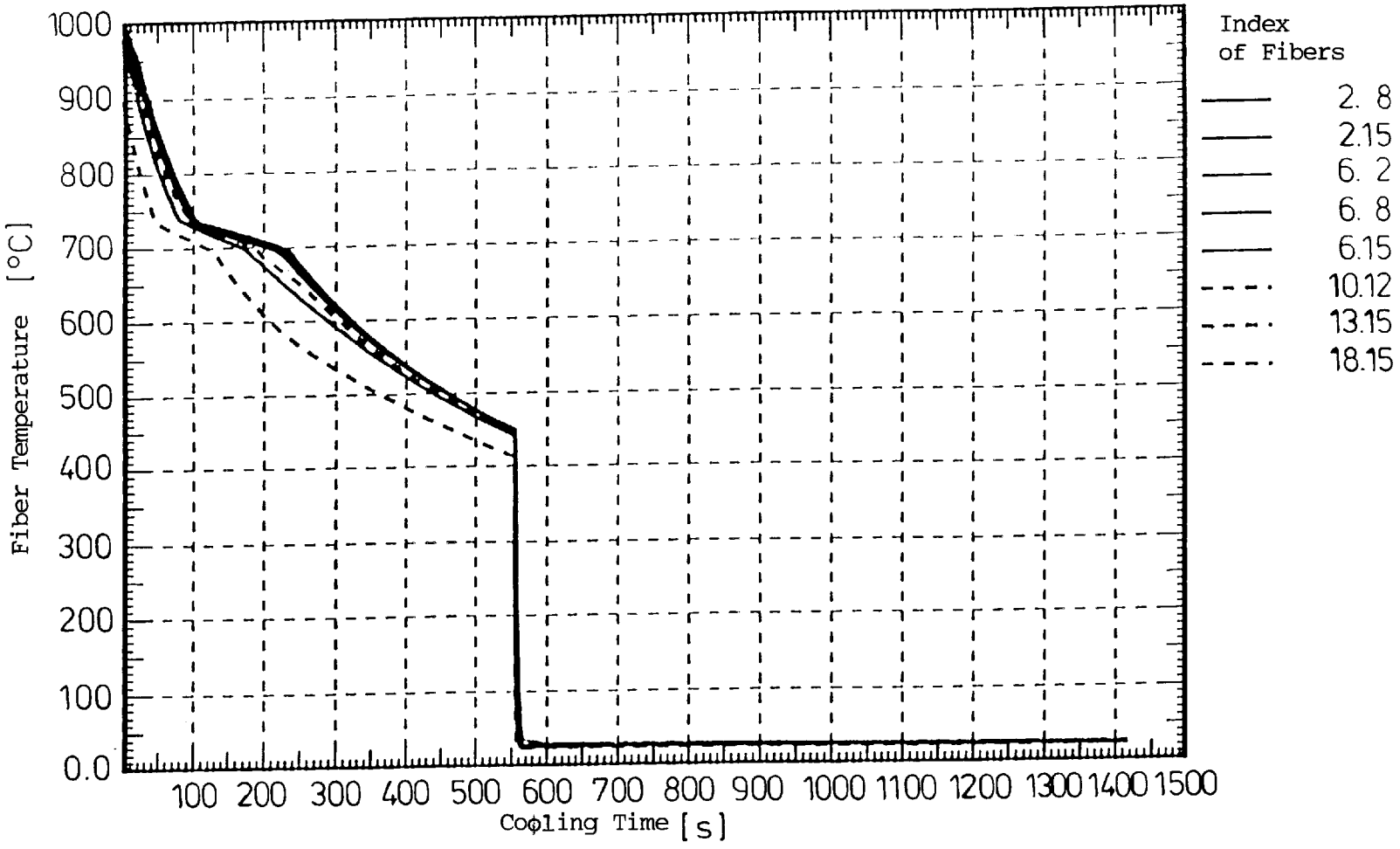
FIG. 2 is a diagram showing the temperature patterns of selected fibers of a sectional steel HEB 140 clamped in accordance with the invention.
Figure 3:
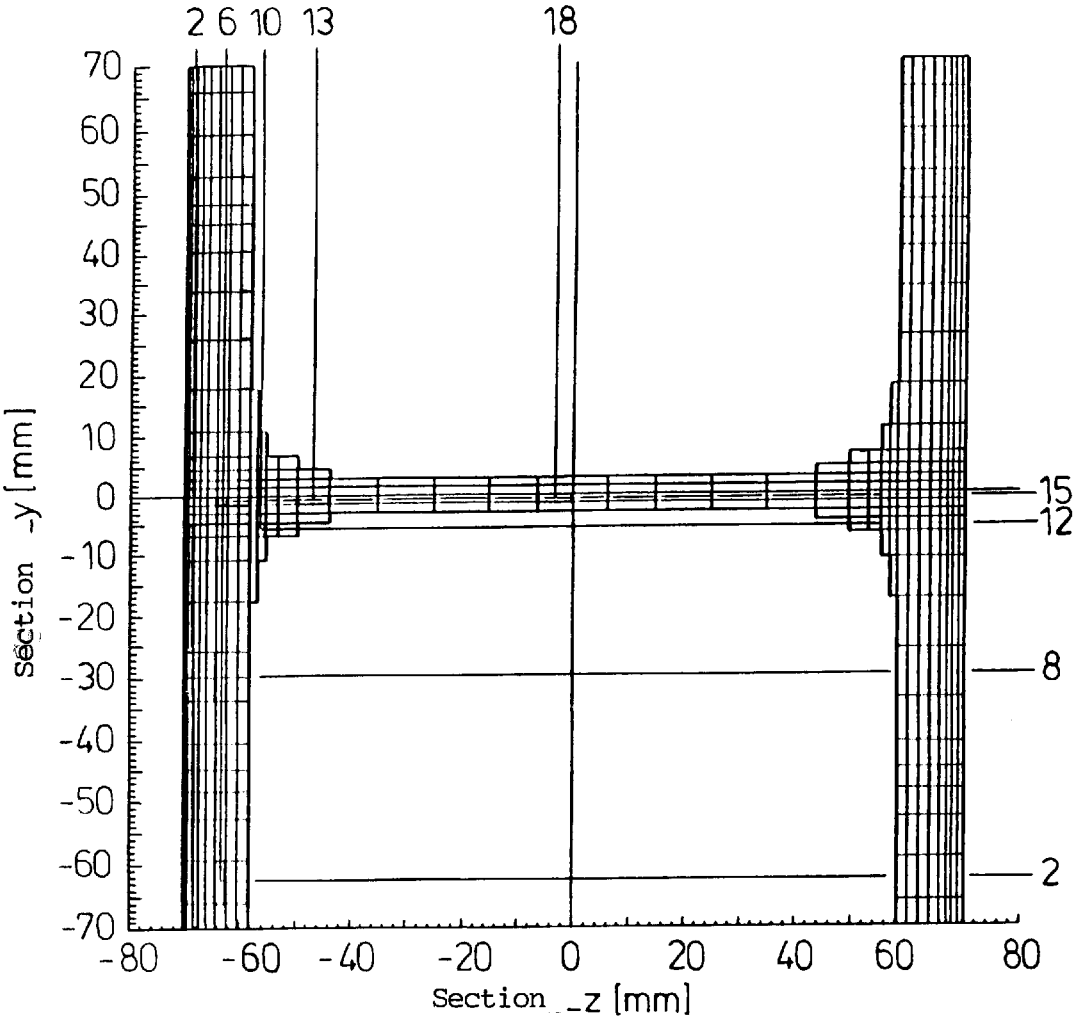
FIG. 3 is an illustration of the sectional steel corresponding to the diagram of FIG. 2.

FIG. 2 shows the temperature patterns of selected fibers of the sectional steel 1 in the case of water cooling with the above-mentioned parameters. The location of the fibers in relation to the cross-section of the sectional steel 1 can be seen in FIG. 3. FIG. 2 illustrates a very rapid cooling of all fibers to below 450° C., which is due to the use of water cooling at T =555 s. Water cooling ends at T =565 s. Clamping of the sectional steel 1 takes place a few seconds before the beginning of the spray cooling, i.e., at T =550 S, and ends a few seconds after the conclusion of the spray cooling, i.e., at T =570 s.

Figure 4:
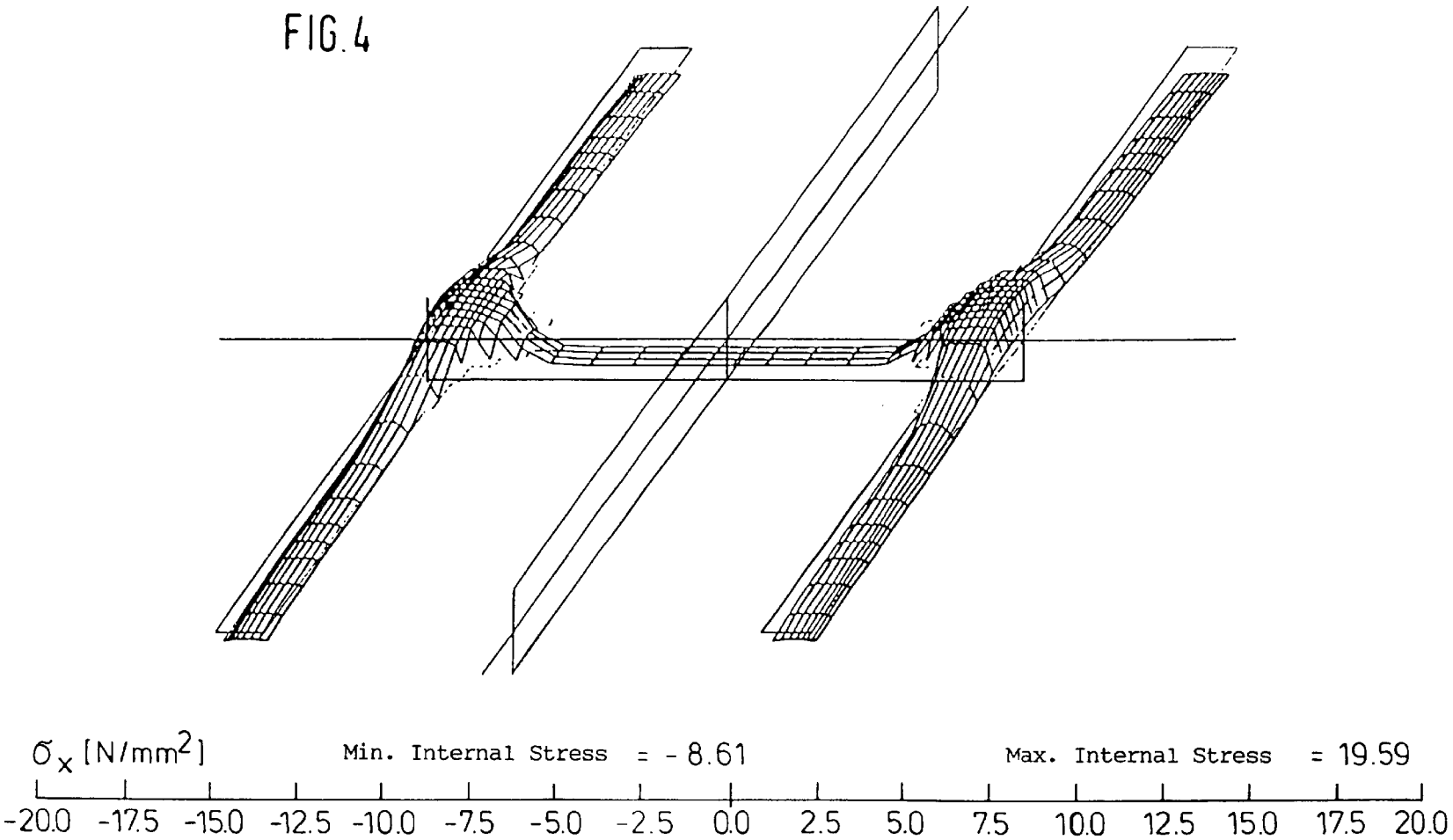
FIG. 4 is a diagram showing the internal stresses remaining in the cross-section of the section of FIG. 3.

FIG. 4 shows the remaining stresses in the cross-section of the sectional steel 1 after water cooling which lasted 10 seconds and clamping which lasted 20 seconds. The maximum occurring internal stress is very low at about 20 N/mm2 (about 4.3 % of the cold yield stress), as compared to results of cooling exclusively in air without clamping.

Figure 5:
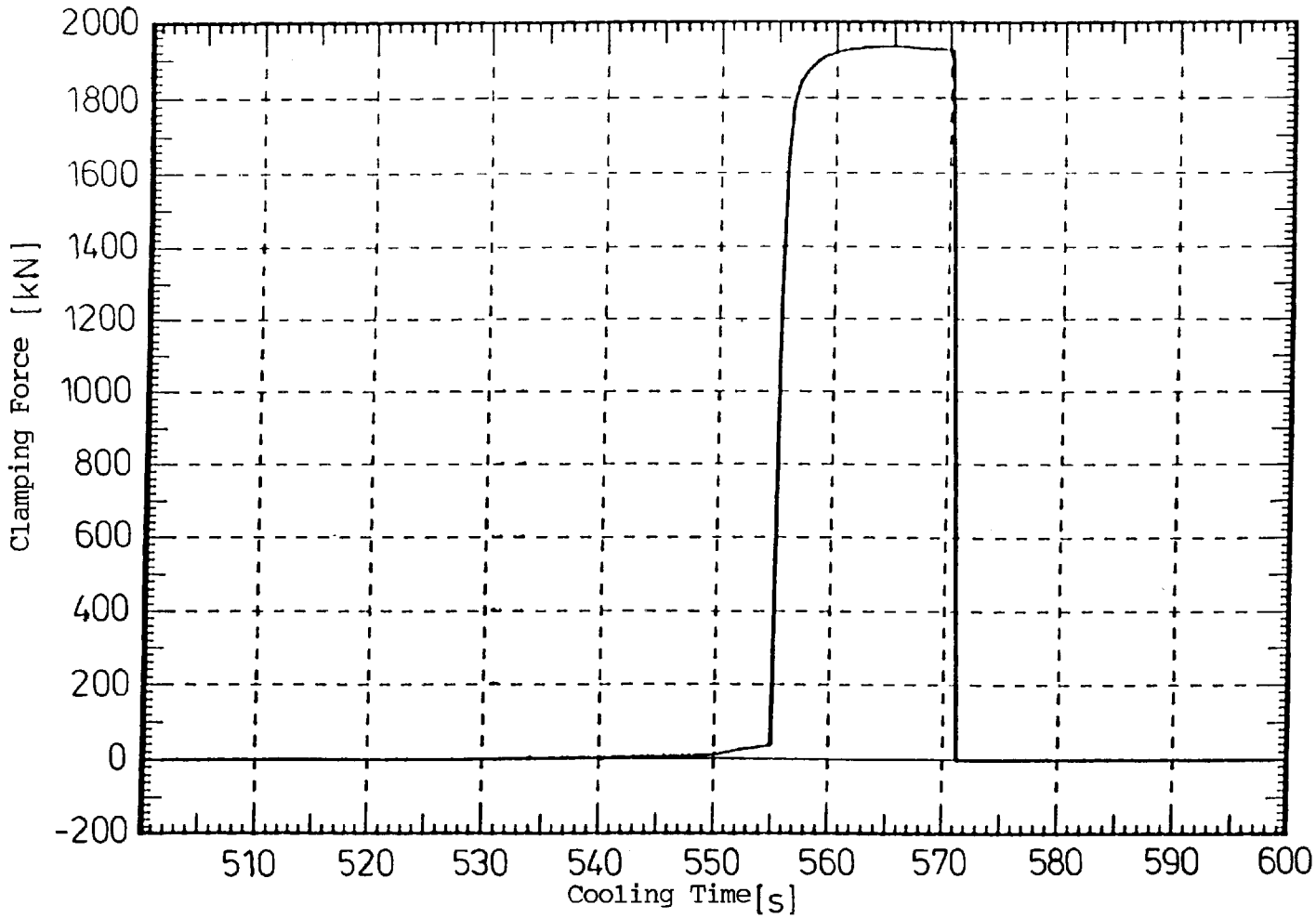
FIG. 5 is a diagram showing the development of the clamping force during the cooling of the sectional steel HEB 140.

FIG. 5 shows the development of the clamping force during the cooling of the sectional steel 1. The maximum occurring clamping force of less than 2,000 kN can be easily managed by technical means.

While specific embodiments of the invention have been shown and described in detail to illustrate the inventive principles, it will be understood that the invention may be embodied otherwise without departing from such principles.

We claim:

1. A method of straightening rolled sectional steel, the method comprising, after a complete transformation of the sectional steel from a thermal elongation into a plastic elongation, clamping and subsequently cooling at least a sectional steel whose maximum local cross-sectional temperature is below $A_{r1}$ and whose minimum local cross-sectional temperature is above a lower limit temperature, wherein due to clamping of the sectional steel the lower limit temperature already causes a thermal elongation in all fibers of the sectional steel which is greater than an elongation which would be required for a plastification of the fibers which would be subjected to the greatest internal compressive stresses if the sectional steel were cooled exclusively in air without clamping.

2. The method of straightening rolled sectional steel according to claim 1, comprising clamping the sectional steel during cooling at ends thereof which are cut off after cooling.

3. The method of straightening rolled sectional steel according to claim 1, wherein means for clamping the sectional steel are stationary during cooling, comprising moving the clamping means at least at one end of the sectional steel to adapt to different lengths of the sectional steel.

4. The method of straightening rolled sectional steel according to claim 1, comprising cooling the clamped sectional steel to a transfer temperature for transferring the sectional steel to a cooling bed.

5. The method of straightening rolled sectional steel according to claim 4, wherein the transfer temperature is about 80° C.

6. The method of straightening rolled sectional steel according to claim 1, comprising cooling the sectional steel in an accelerated manner.

7. The method of straightening rolled sectional steel according to claim 6, comprising cooling the sectional steel with liquid.

8. The method of straightening rolled sectional steel according to claim 7, comprising applying the liquid with spray nozzles.

* * * * *